US005279087A

United States Patent [19]

Mann

[11] Patent Number: 5,279,087

[45] Date of Patent: Jan. 18, 1994

[54] SMOKE SEAL

[75] Inventor: Robert M. Mann, Exeter, Great Britain

[73] Assignee: Lorient Polyproducts Limited, United Kingdom

[21] Appl. No.: 868,603

[22] Filed: Apr. 14, 1992

[30] Foreign Application Priority Data

Apr. 15, 1991 [GB] United Kingdom ..... 9107945

[51] Int. Cl.[5] ..... E04C 2/00

[52] U.S. Cl. ..... 52/232; 49/477.1

[58] Field of Search ..... 52/232, 716; 49/477, 49/486, 475

[56] References Cited

U.S. PATENT DOCUMENTS 4,246,304 1/1981 Dixon ..... 52/232
4,963,403 10/1990 Roberts et al. ..... 52/716 X

FOREIGN PATENT DOCUMENTS 3720287 1/1989 Fed. Rep. of Germany ..... 52/232
2335134 7/1977 France .
7613604 6/1977 Netherlands ..... 52/232
2070114 9/1981 United Kingdom .
2092214 8/1982 United Kingdom .

*Primary Examiner*—Carl D. Friedman
*Assistant Examiner*—Creighton Smith
*Attorney, Agent, or Firm*—Jones & Askew

[57] ABSTRACT

A fire and smoke seal assembly including an elongate casing housing intumescent material and a flexible elongate seal member projecting from the casing, the casing and seal member being co-extruded from compatible plastics materials so as to be integrally connected, the flexible elongate seal member extending along and adjacent to one side of the casing.

9 Claims, 2 Drawing Sheets

SMOKE SEAL

The present invention relates to a fire and smoke seal assembly primarily intended for providing a fire and smoke seal between a door and its supporting frame.

It is known to provide a fire and smoke seal assembly which includes an elongate casing housing intumescent material for providing a fire seal and a flexible elongate seal member projecting from the housing for providing a smoke seal. The flexible elongate seal member is separately formed with the casing and normally comprises a brush element or a blade element which is received in a groove formed in the casing.

In use, the casing is located in a groove formed either in a door surround or an edge face of the door such that the seal member extends across the gap between the closed door and its surround. The groove is formed centrally relative to the door edge face so that in the event of a fire on either side of the door the performance of the intumescent material within the seal assembly is the same.

Ideally the width of the casing is a maximum within the constraints of the width of the door edge face so as to provide a wide face for exuding the intumescent material.

The provision of a smoke seal on the casing in conventional constructions either restricts the available width of the casing for housing intumescent material or requires an increase of height which would lead to delay in activation of the seal under fire conditions. In addition, when securing hinges to the door or surround, it is normal practice to rebate the door or surround to accommodate the hinge and in view of the width restraint on a door or surround, the hinge rebate normally passes through the seal assembly. Accordingly, in the region of a hinge at least the smoke seal is removed and thereby provides a passageway for smoke in the event of a fire.

According to one aspect of the present invention there is provided a fire and smoke seal assembly including an elongate casing housing intumescent material and a flexible elongate seal member projecting from the casing, the casing and seal member being co-extruded from compatible plastics materials so as to be integrally connected, the flexible elongate seal member extending along and adjacent to one side edge of the casing.

Preferably the casing is generally rectangular in cross-section and the flexible seal member extends along and projects from a corner edge of the casing. In this manner the seal element is located at one side extremity of the casing and thereby enables the casing to present a full width face through which the intumescent material may exude. At the same time, the height of the casing does not have to be increased in order to accommodate a separate flexible sealing element.

Location of the flexible seal member to one extreme side of the casing enables a hinge rebate to extend across the door edge face or surround by a substantial proportion of the available width without interfering with the smoke seal.

Various aspects of the present invention are hereinafter described with reference to the accompanying drawings, in which.

Figure 1:
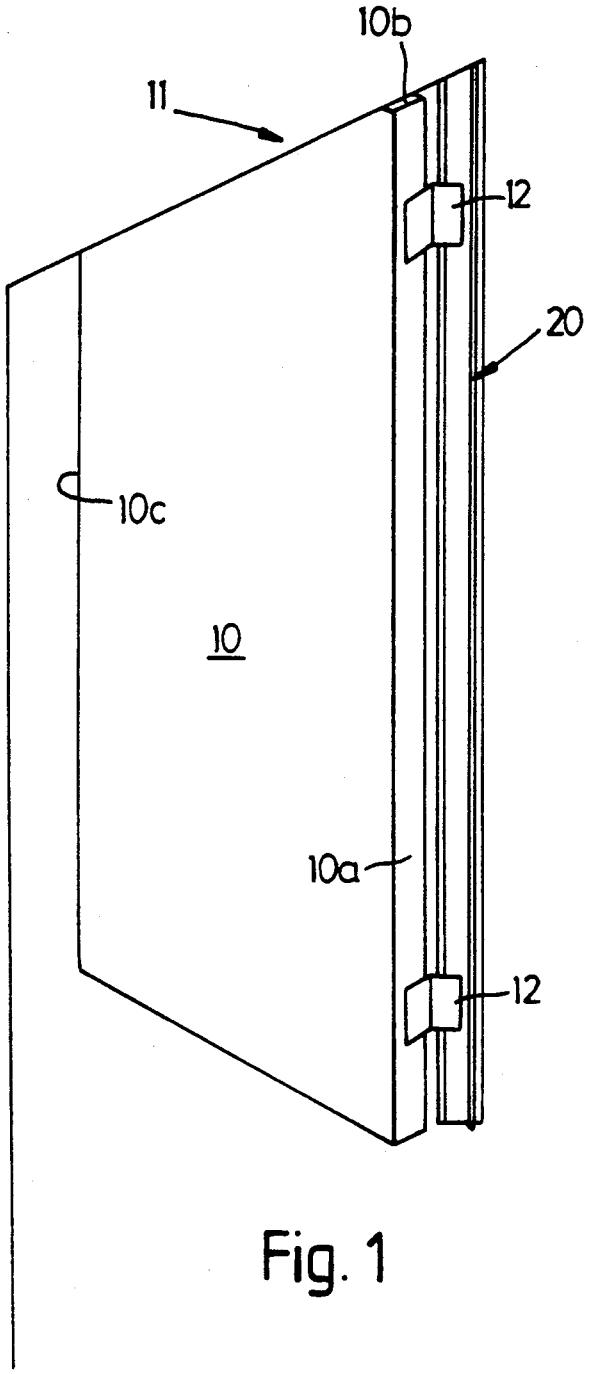
FIG. 1 is a schematic perspective view of a door and surround including a fire and smoke seal assembly according to the present invention.

Referring initially to FIG. 1 there is shown a door 10 hingedly mounted in a door surround or frame 11 by a pair of hinges 12.

A fire and smoke seal assembly 20 is mounted in the frame 11 and extends along all 3 sides so as to completely surround the side and top edges of the door. Although the assembly 20 is shown mounted in the frame it will be appreciated that the assembly may alternatively be mounted within the door edges.

Figure 3:
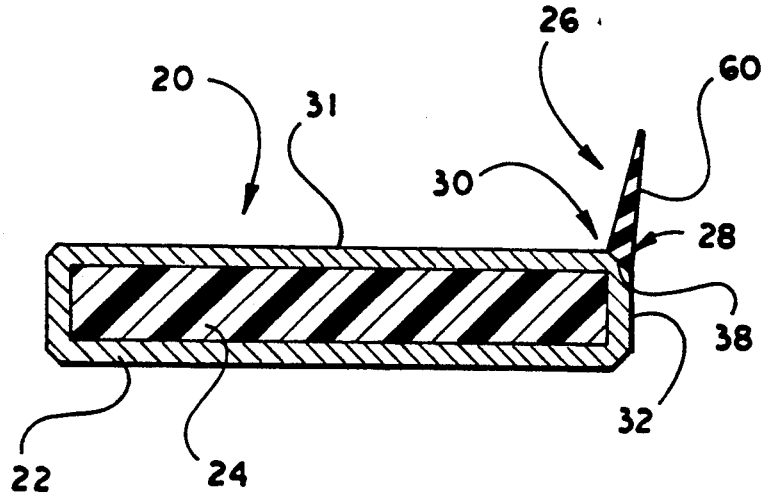
FIG. 3 is a cross-sectional view of the fire and smoke seal assembly shown in FIG. 1.

As shown in FIG. 3 the assembly 20 includes a hollow casing 22 in which is housed an intumescent material 24. A suitable intumescent material is Palusol (RTM).

An elongate seal member 26 in the form of a blade or lip is provided which is located at one side of the casing 22. In use the terminal tip of the lip engages against the opposing edge of the door to create a smoke seal. In the example of FIG. 1, the lip of the assembly extending along the hinge side of the frame will be engaged by edge 10*a* of door 10 and placed under compression on closing of the door. The lips of the assemblies extending along the other side of the frame will wipe across the faces of edges 10*b* and 10*c*.

The seal member 26 has a base or root portion 28 which is integrally connected with the casing 22. The casing 22 is formed from a plastics material and the casing and seal member 26 are preferably co-extruded in order to provide the integral connection.

Preferably the casing 22 is rectangular in cross-section and the root portion 28 is located at one corner edge 30 between the front face 31 and a side face 32 of the casing. This enables an inclined interface 38 to be provided so that the root portion 28 may have a relatively thick dimension to provide good anchorage, without the root portion projecting substantially beyond the thickness of the wall of the casing defining side face 32. Thus the full width of face 31 is available for the intumescent material to exude through.

Preferably a side face 60 of the seal member is contiguous with side face 32 so as to define a flush transition between faces 60 and 32.

Figure 4:
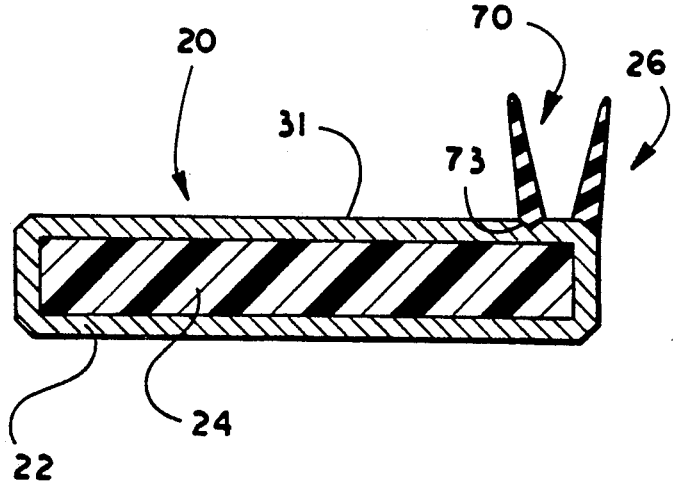
FIG. 4 is a cross-sectional view similar to FIG. 3 of another embodiment according to the present invention.

As illustrated in FIG. 4, a supplementary blade seal member 70 may be provided if desired. Seal member 70 is of the same construction as seal member 26 and is also co-extruded with casing 22 to provide an integral connection. If desired, seal members 26,70 may be of different heights. The interface 73 between blade member 70 and the wall of the casing defining face 31 is preferably generally 'V' shaped in order to provide a relatively wide interface for good anchorage. More than one supplementary seal member 70 may be provided if desired.

The casing 22 is preferably formed from a rigid plastics material such as rigid polyvinylchloride and the seal members 26,70 are preferably formed from a flexible thermoplastics such as polyvinylchloride or a flexible thermoplastics elastomer which is compatible with the rigid polyvinylchloride.

In use the seal assembly 20 is mounted in a groove which is located centrally relative to the door edge. The side of the assembly 20 carrying the seal member 26 is located furthest away from the side of the surround on which the pivot of the hinge 12 is located.

Figure 2:
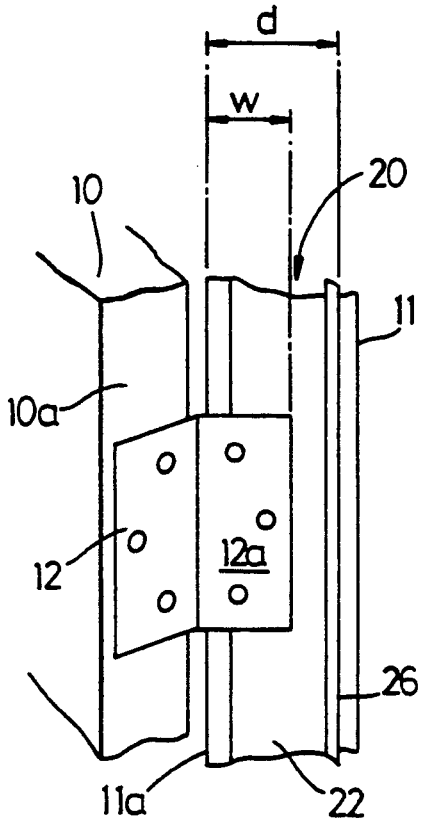
FIG. 2 is a more detailed schematic view of part of the door and surround shown in FIG. 1.

Thus as seen in FIG. 2, the seal member 26 is located by a substantial distance d from the edge 11*a* of the frame 11 and this distance d is chosen to be in excess of the width w of the hinge plate 12*a*. Accordingly formation of a rebate to accommodate hinge plate 12*a* does not destroy seal member 26 and so a continuous smoke seal is provided along the hinged side of the door.

I claim:

1. A fire and smoke seal assembly comprising:

an elongate casing housing intumescent material, the casing having a corner defined at the junction of a first wall and a side wall defining a side face of the casing; and a flexible elongate seal member projecting beyond said first wall and having a root portion integrally connected to said corner so that the elongate flexible member extends along and to said side wall in order to provide a continuous smoke seal along one side of the casing;

the casing and seal member being co-extruded from compatible plastics material and the root portion being integrally connected to said corner via an interface inclined relative to said first wall, such that the root portion does into project substantially beyond the thickness of said side wall.

2. A seal assembly according to claim 1, wherein the casing is generally rectangular in cross-section.

3. A seal assembly according to claim 2, wherein the elongate seal member comprises a blade or lip.

4. A seal assembly according to claim 3, wherein the blade or lip has a side face which is contiguous with said side face of the casing.

5. A seal assembly according to claim 1, wherein the casing is extruded from a rigid plastic material.

6. A seal assembly according to claim 1 wherein a further seal member is co-extruded with the casing, the further seal member being located in-board from said seal member.

7. A seal assembly according to claims 1 or 6 wherein the or each seal member is formed from a flexible thermoplastic.

8. A seal assembly according to claim 7 wherein the thermoplastic is an elastomer.

9. A fire and smoke seal assembly comprising:

an elongate casing housing intumescent material;

a flexible elongate seal member projection beyond a wall of the casing and integrally connected to said wall of the casing;

the casing and seal member being co-extruded from compatible plastic materials so as to integrally connect the flexible elongate member to said wall;

the flexible elongate seal member extending along and adjacent to one side of the casing so as to provide a continuous smoke seal along the one side;

the casing being generally rectangular in cross-section and the flexible seal member extending along and projecting from a corner edge of the casing;

the elongate seal member comprising a blade or lip having a root portion integrally connected with a corner of the casing, the corner of the casing being defined at the junction of said wall and a side wall defining a side face of the casing; and the blade or lip having a side face which is contiguous with said side face of the casing.

* * * * *